US008795027B2

(12) United States Patent
Kelderhouse

(10) Patent No.: US 8,795,027 B2
(45) Date of Patent: Aug. 5, 2014

(54) CO2 MODEL CAR LAUNCHER

(75) Inventor: Charles Kelderhouse, Roswell, GA (US)

(73) Assignee: Boy Scouts of America, Irving, TX (US)

( * ) Notice: Subject to any disclaimer, the term of this patent is extended or adjusted under 35 U.S.C. 154(b) by 263 days.

(21) Appl. No.: 13/325,083

(22) Filed: Dec. 14, 2011

(65) Prior Publication Data

US 2013/0040534 A1 Feb. 14, 2013

Related U.S. Application Data

(60) Provisional application No. 61/521,417, filed on Aug. 9, 2011.

(51) Int. Cl.
*A63H 29/16* (2006.01)

(52) U.S. Cl.
USPC ..... 446/429; 446/228; 446/444

(58) Field of Classification Search
USPC ..... 446/63, 64, 65, 429, 444, 58, 228
See application file for complete search history.

(56) References Cited

U.S. PATENT DOCUMENTS

| | | | | | |
|---|---|---|---|---|---|
| 1,621,140 | A | * | 3/1927 | Thompson | 446/228 |
| 2,545,586 | A | * | 3/1951 | Pollak | 446/56 |
| 3,577,677 | A | * | 5/1971 | Bennett et al. | 446/211 |
| 3,844,557 | A | * | 10/1974 | Pompetti | 463/58 |
| 3,902,271 | A | * | 9/1975 | Turoff et al. | 446/65 |
| 3,950,889 | A | * | 4/1976 | Dabney | 446/212 |
| 4,605,230 | A | * | 8/1986 | Halford et al. | 273/129 AP |
| 4,925,188 | A | * | 5/1990 | McKay et al. | 463/59 |
| 5,254,030 | A | * | 10/1993 | Ostendorff et al. | 446/430 |
| 5,409,187 | A | * | 4/1995 | Dunham | 244/149 |
| 5,651,736 | A | * | 7/1997 | Myers | 463/64 |
| 5,711,595 | A | * | 1/1998 | Gerbe | 362/84 |

* cited by examiner

*Primary Examiner* — Vishu K. Mendiratta
(74) *Attorney, Agent, or Firm* — Fox Rothschild LLP; Richard C. Woodbridge; Ryan N. Miller

(57) ABSTRACT

A CO2 gas-propelled model car launcher permits two or more model vehicles to be launched substantially simultaneously. Launching of the vehicles is achieved by moving a trigger plate sidewise which disengages a disc and thereby releases a firing pin whose forward movement punctures the CO2 cartridge. A height adjustment feature permits the launcher to accommodate model cars of different sizes. Multiple launchers may be ganged together and their trigger plates rigidly connected in such a way that sidewise movement of one trigger plate launches all of the model vehicles.

19 Claims, 17 Drawing Sheets

CO2 MODEL CAR LAUNCHER

CROSS-REFERENCE TO RELATED APPLICATIONS

This application relates to and claims the priority of U.S. Provisional Patent Application Ser. No. 61/521,417 filed Aug. 9, 2011 by Charles Kelderhouse and entitled "CO2 Model Car Launcher", the entire contents and substance of which are hereby incorporated in total by reference.

BACKGROUND OF THE INVENTION

1. Field of the Invention

The invention comprises an apparatus for launching a plurality of CO2 propelled model cars simultaneously.

2. Description of the Prior Art

The use of pressurized carbon dioxide gas ("CO2") cartridges to propel model racing cars has been known for a long time. The cartridges used are of the type known to pressurize seltzer bottles and the like. The following prior art devices are typical of relevant model vehicle launchers.

U.S. Pat. No. 5,711,695 discloses a gas-propelled toy with an exhaust nozzle for a gas cartridge. A plug terminal on the toy prevents the release of the gas from the cartridge and may be pierced by a firing pin. The firing pin may be mounted to a stationary blast wall, or a moveable support, such as a board, or, alternatively, the firing pin may be unattached. Once the plug terminal is pierced, the pressurized gas exits the cartridge through the neck outlet resulting in the creation of thrust.

U.S. Pat. No. 3,950,889 discloses a pressurized gas driven vehicle and method for launching a group of them where the vehicles are positioned in line with all other vehicles by a starting positioner in the form of a movable barrier pivoted on a hinge and are attached to their respective guide cables. A pressure chamber is mounted in the vehicles and a nozzle, mounted on the rear of the body to enclose the pressure chamber, is provided with a jet outlet passage, through which pressurized gas is released. When released at high velocity through the jet outlet passage, pressurized gas effects a leftward action which, in reaction, propels the car rightward.

U.S. Pat. No. 5,141,467 discloses a powered toy utilizing explosive caps to drive the toy vehicle from a launcher, the toy having an open-ended detonating chamber portion as a part of the connector portion, which is structured to receive a piston portion or ram portion. The piston portion is affixed to the vehicle and is assembled with the chamber portion to confine a cap of the type used in toy cap guns. When the cap is detonated the sudden expansion of combustion gases in the chamber increases the pressure, causing the piston to be driven from the chamber which rapidly propels the vehicle.

U.S. Pat. No. 2,803,922 discloses a toy vehicle and launching device therefore, the launching device being operated by pulling back on a plunger rod to compress and place an actuating spring under tension. The car is then placed on the platform with its rear extremity abutting the front wall of the housing and the projection extending through the opening so that its end is located in a predetermined position, after which the plunger rod is released causing the hammer to strike the projection with considerable force to project the car forwardly.

U.S. Pat. No. 3,844,557 discloses a rocket motor driven model racing vehicle having a reaction engine providing between 12 and 38 newtons of thrust. The racing vehicle is tethered to a monofilament plastic line.

U.S. Pat. No. 4,690,654 discloses a toy vehicle carrying case and launcher where depression of a firing button causes a projection to contact a firing lever moving a latch out of a vehicle cavity allowing an impact plate to propel the vehicle forwardly by the force of a launching spring.

U.S. Pat. No. 4,291,878 discloses a starting gate for a multiple-track toy vehicle racing set where the base of the starting gate includes two plate-shaped projections to which the respective ends of tracks can be connected. The base also includes two depressions, each of which constitutes a bay in which a respective charged toy vehicle can be accommodated prior to the beginning of the race.

U.S. Pat. No. 5,499,940 entitled "Fluid Powering and Launching System for a Toy Vehicle" describes in FIGS. 11 and 12 a manual compressed air system for launching two vehicles simultaneously.

U.S. Pat. No. 7,601,068 discloses a slot car system for simultaneously launching at least two vehicles at the same time.

U.S. Pat. No. 4,605,229 entitled "Toy Drag Strip and Starting Tower" describes another device which permits multiple cars to be raced simultaneously side by side.

In conclusion, the prior art appears to disclose the launching of multiple compressed air devices in at least U.S. Pat. Nos. 3,950,889 and 5,499,940. The launching of multiple model race cars having different forms of propulsion is described at least in the following U.S. Pat. Nos. 3,844,557; 4,291,878; 4,605,299; and, 7,601,068.

It is very important that any CO2 launcher launch all model vehicles in a totally fair and consistent manner so that the winner of the race is determined by the skill of the model maker and not the launch mechanism.

While there do appear to be devices for launching two or more vehicles simultaneous, they don't appear to have caught on commercially because they are believed to be expensive to manufacture and relatively unreliable and balky. In contrast, the present invention is inexpensive to manufacture and can be easily assembly by youngsters and safely used. It was in the context of the above prior art that the current invention arose.

SUMMARY OF THE INVENTION

Briefly described, the present invention comprises an apparatus for simultaneously launching two or more CO2 propelled model racing cars in a safe and consistent manner. The launcher includes a base plate that supports two towers which in turn support two launch modules. A trigger plate is also supported by grooves in another pair of vertical supports attached to the base plate. Each launch module includes a firing pin mechanism that comprises: a rod, a sharp tip at one end of the rod, a knob at the second end of the rod, and a disc located intermediate the knob and the sharp tip. The disc has a short side and a long side so that when properly rotated it can pass through one of the two slots in the trigger plate. The launcher is armed, or cocked, by pulling outwardly on the knob and rotating it so that the disc can pass through one of the two respective slots in the trigger plate then rotated again so that the long, or fat, part of the disc engages the plate itself and is held in that position by the force of a spring inside the launch module. The CO2 Model cars are then placed into the launch modules so that the frangible CO2 exhaust nozzle comes into contact with the sharp end of the firing pin. Pulling sidewise on the trigger plate causes the fat parts of the discs to simultaneously disengage from their respective slots thereby allowing the spring to slam the sharp end of the firing pin into the frangible end of each CO2 cartridge releasing both at the same time so that a fair race can take place. The invention also includes features that allow the launch modules to adjust for model cars of differing heights and also includes a feature that allows launchers to be ganged together so that more than two race cars can be simultaneous launched.

The invention will be more fully understood by reference to the following drawings.

DESCRIPTION OF THE PREFERRED EMBODIMENT

During the course of this description like numbers will be used to identify like elements according to the different drawings that illustrate the invention.

Figure 1:
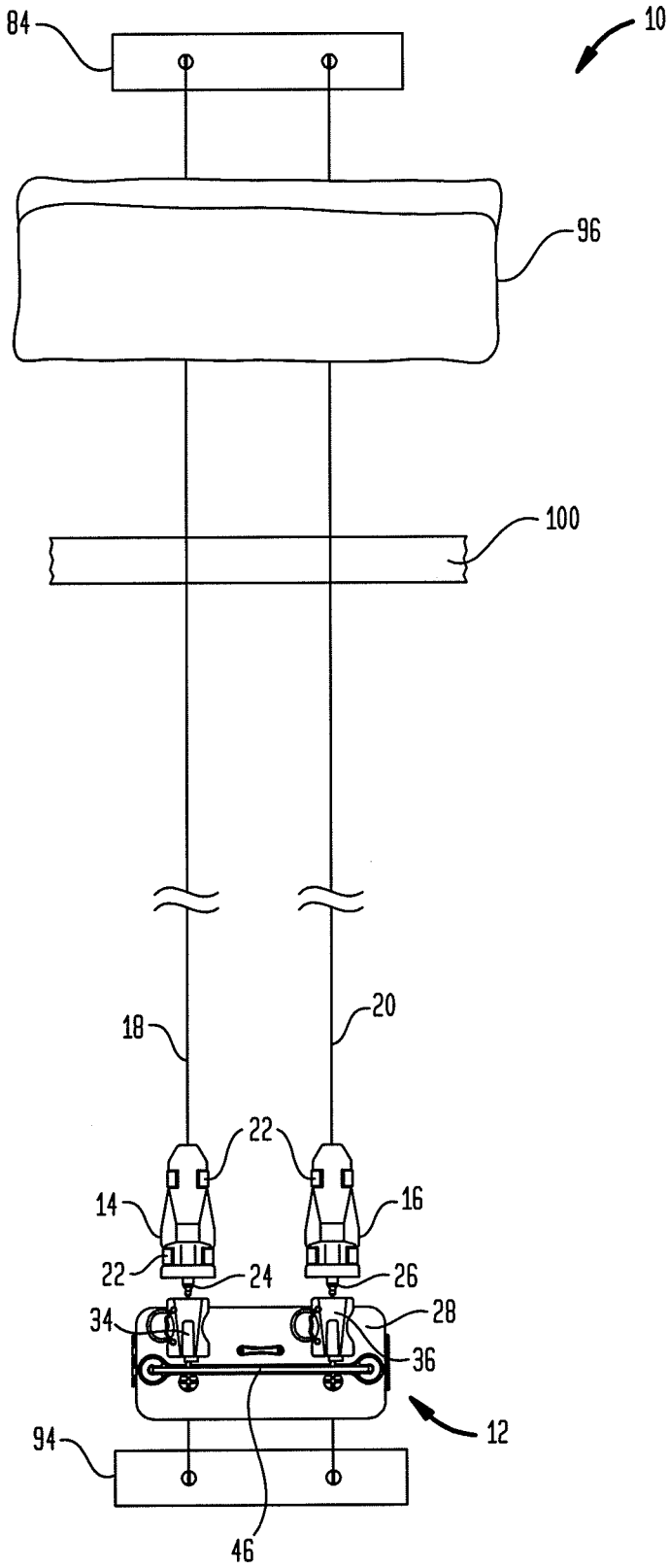
FIG. 1 illustrates a typical model race car track according the preferred embodiment of the invention where two cars may be simultaneously launched and race down guide wires towards a stop block at the far end.

FIG. 1 illustrates a typical model race car track according to the preferred embodiment of the invention (10) wherein a first model car (14) and a second model car (16) may be simultaneously launched by a launcher (12). Model cars (14, 16), supported by wheels (22), are guided respectively by wires (18,20) which are anchored at one end by launcher (12) and the other end by a stop block (84). Model cars (14,16) are respectively propelled by CO2 cartridges (24,26) which are simultaneously punctured by moving trigger plate (46) sidewise in a manner described below.

Figure 2:
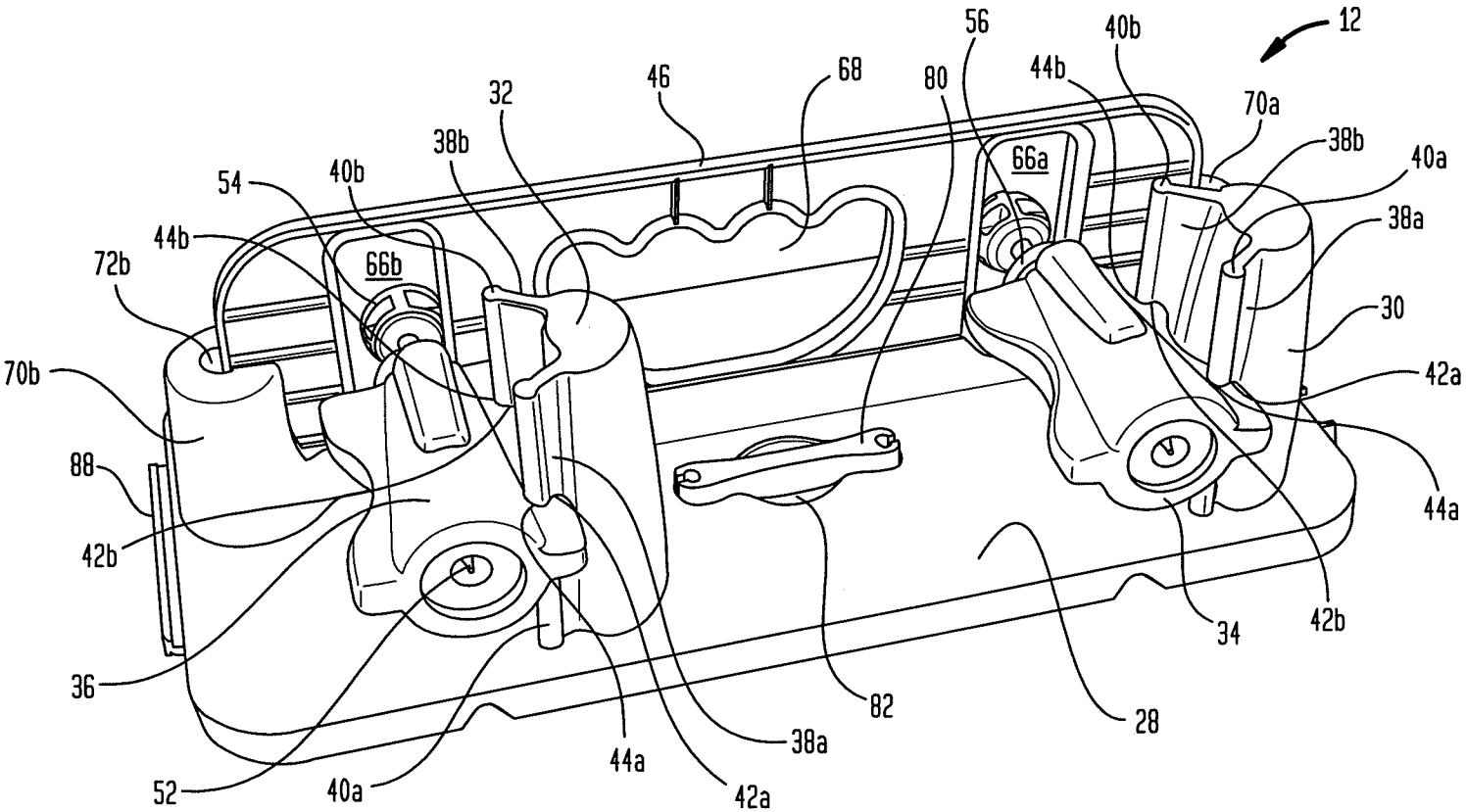
FIG. 2 is a front perspective view of the present invention according to the preferred embodiment thereof.
Figure 3A:
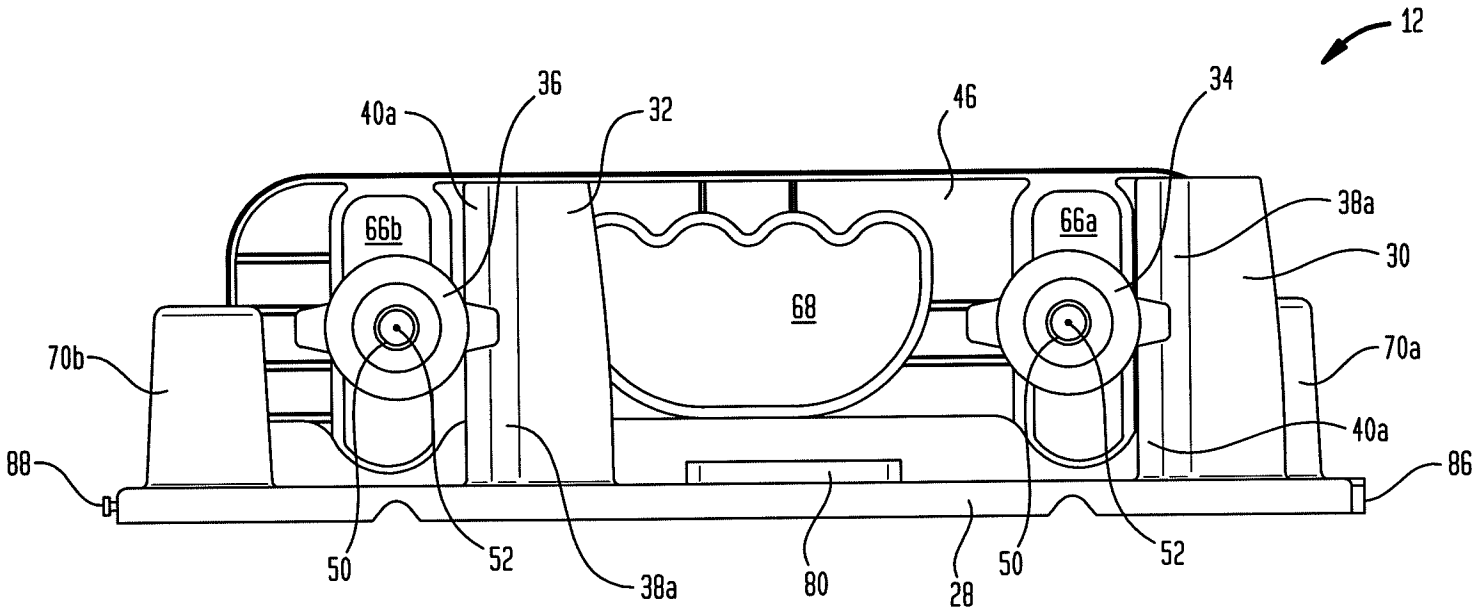
FIG. 3A is a front elevation view of the launcher of FIG. 2.
Figure 3B:
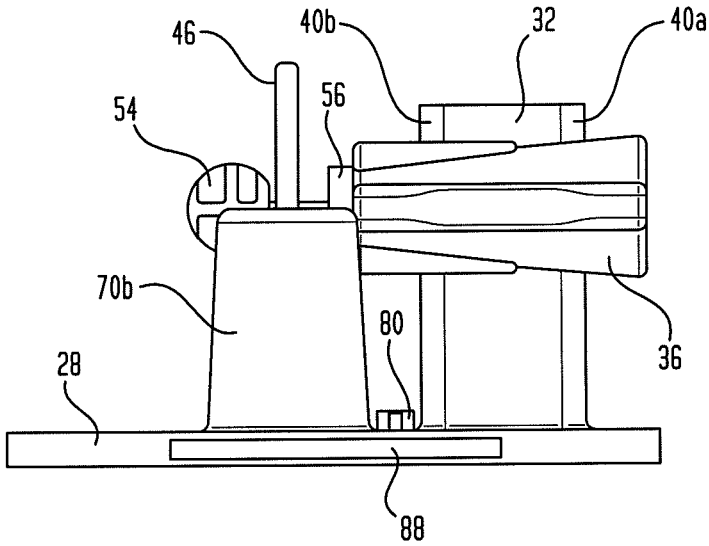
FIG. 3B is a left side elevation view of the launcher of FIG. 2.
Figure 3C:
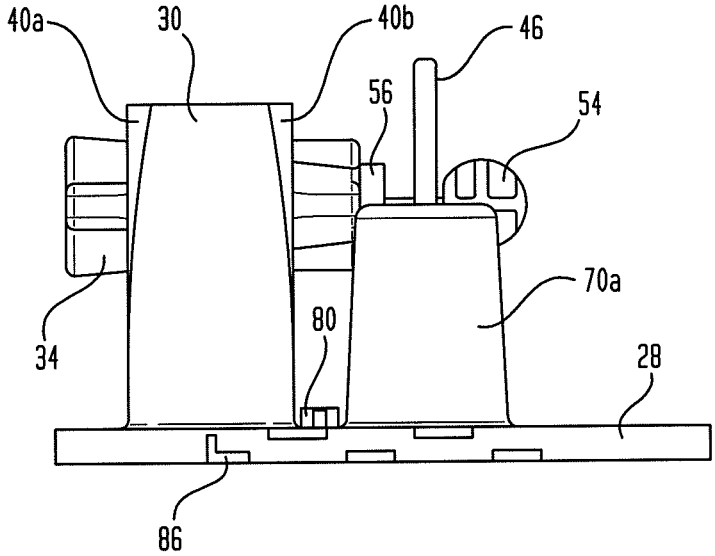
FIG. 3C is a right side elevation view of the launcher of FIG. 2.
Figure 3D:
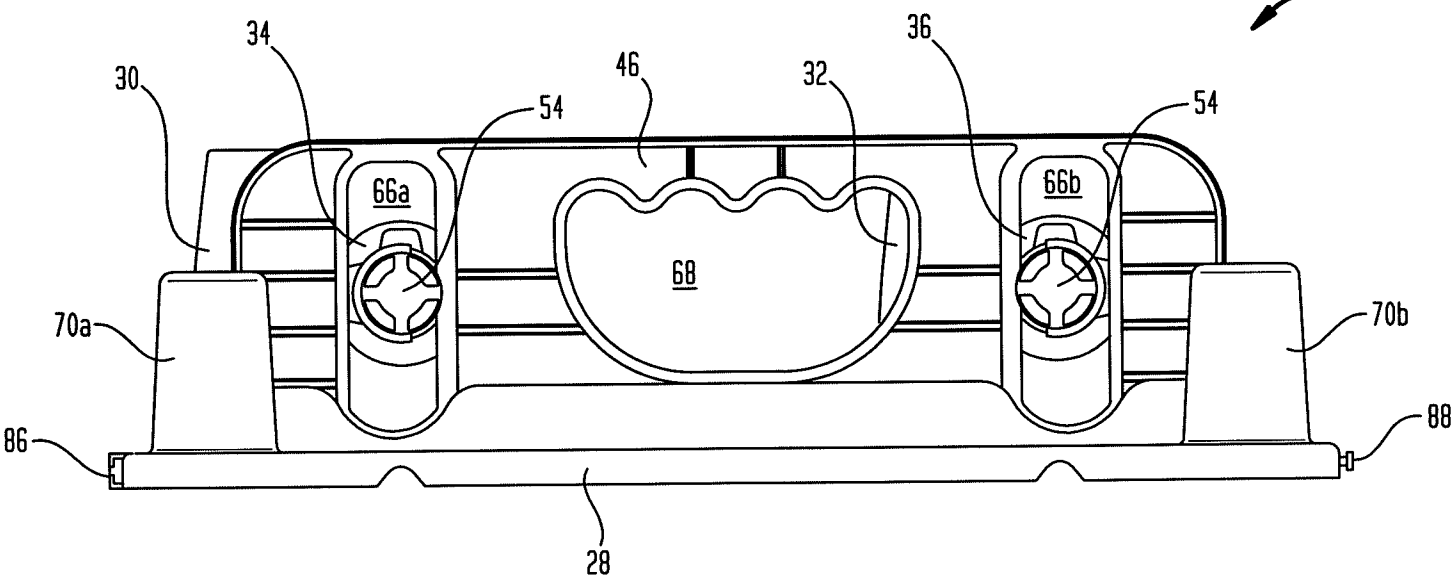
FIG. 3D is a rear elevation view of the launcher of FIG. 2.
Figure 3E:
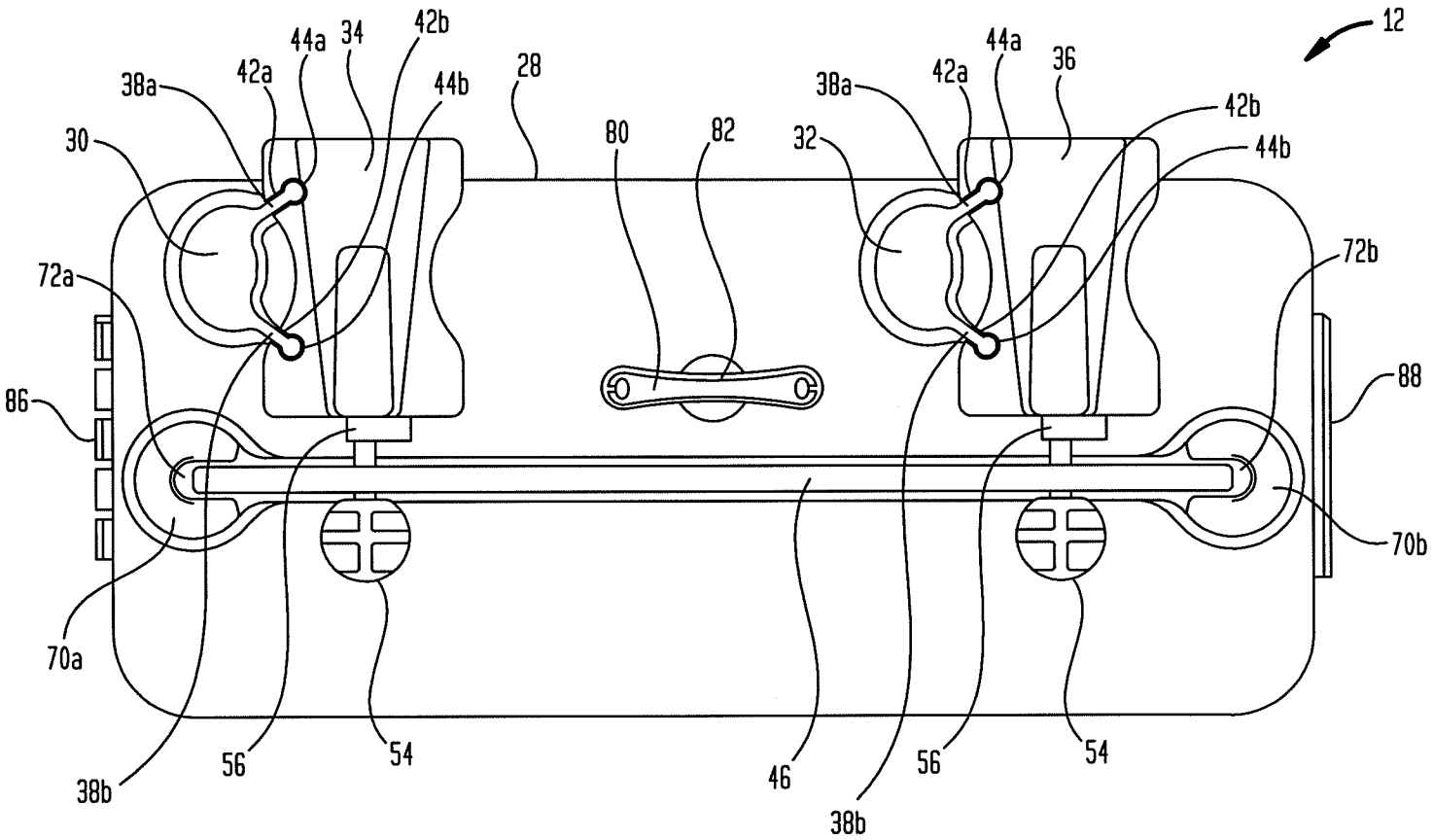
FIG. 3E is a top plan view of the launcher of FIG. 2.

The launcher (12) is shown in a front perspective view in FIG. 2. FIGS. 3A, 3B, 3C, 3D, and 3E also show the launcher (12) from the front, from the left side, from the right side, from the rear, and from a top plan view. The major features of launcher (12) are a relatively flat launcher base plate (28), a first and a second tower (30,32), a first and a second launch module (34,36) attached respectively to towers (30,32), and a trigger plate (46) supported by a first and a second support means (70*a*,70*b*). Towers (30,32) each have a first and a second adjustment fin (38*a*,38*b*). Each of the fins (38*a*,38*b*) include, respectively, a first bead (40*a*) and a second bead (40*b*) along the edges thereof. Launch modules (34,36) each include a first and a second groove (42*a*,42*b*) which terminate at a first and a second enlarged opening (44*a*,44*b*). The first fin (38*a*) with its corresponding bead (40*a*) is received in the first groove (42*a*) so that the bead (40*a*) is held by the first enlarged opening (44*a*). Similarly, the second fin (38*b*), with its corresponding beaded edge (40*b*), is received in the second groove (42*b*) with its enlarged opening (44*b*) accepting the bead portion (40*b*). Beads (40*a*,40*b*) are secured by the enlarged openings (44*a*,44*b*) so that the launch modules (34,36) do not disengage from the fins (38*a*,38*b*). The important and unique aspect of this arrangement is that it permits the launch modules (34,36) to move up and down, vertically, along the height of the towers (30,32) so that the launch modules (34,36) can be paired up with cars (14,16) in which the wheels (22) may be of different heights or, wherein the location of the CO2 cartridge (24,26) is at a different height from car to car. The engagement is a friction fit and the height adjustment is made simply by pulling up or pushing down on the appropriate launch module (34,36).

Figure 4A:
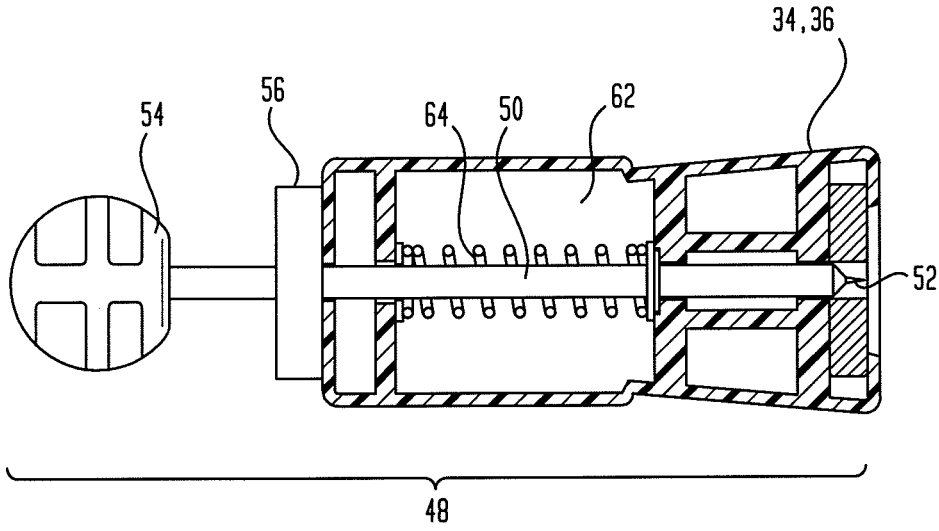
FIG. 4A is a side cross-sectional view of an individual launch module showing the firing pin mechanism in the post launch position immediately prior to cocking.

FIG. 4A is a side cross-sectional view of an individual launch module (34,36) showing the firing pin mechanism (48) in the post launch position immediately prior to cocking.

FIGS. 4B-4G illustrate the steps necessary to cock and then release the firing pin mechanism (48).

The firing pin mechanism (48) is housed within a cavity (62) of each of the launch modules (34,36). It comprises a rod (50) having a sharp point (52) at a first end of the rod (50) and a pull knob (54) located at the second end of the rod (50) distal from the sharp point (52). A disc (56) is located on rod (50) intermediate the pull knob (54) and the sharp point (52). Disc (56) has a long side, or big radius (60) and a short side, or small radius (58). The term "long" is used to indicate that the radius of the disk (56) is greater from the rod (50) to the long side (60) than it is to the short side (58). The interior cavity (62) inside of launch modules (34,36) includes a return spring (64) that biases the firing pin rod (50) towards the forward position.

The trigger plate (46) is received at each end thereof in vertical grooves (72*a*,72*b*) located in the first and second trigger support means (70*a*,70*b*). Vertical grooves (72*a*,72*b*) face each other and include just enough depth in them so that the trigger plate (46) can be moved sideways from a first pre-launch (74) to a second post-launch (76) position without slipping out of the grooves (72*a*,72*b*). Trigger plate (46) includes a handle grip hole (68) which permits the user to readily grab onto the trigger plate (46) so that the trigger plate (46) can be moved from side to side. Trigger plate (46) also includes a first and a second slot (66*a*,66*b*) that permits the rod portions (50) of the firing pin mechanism (48) of each of the launch modules (34,36) to pass there through.

Figure 4B:
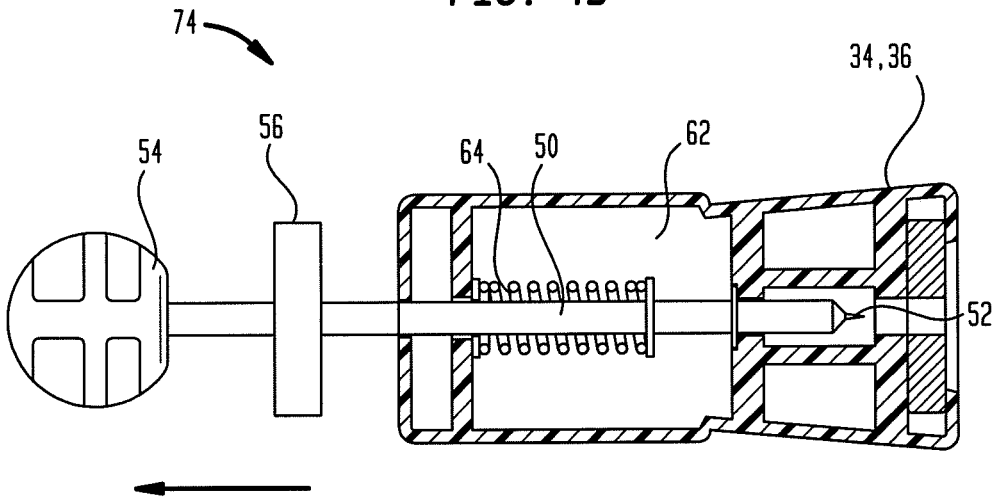
FIG. 4B shows the first step in the cocking process in which the knob is pulled back against the bias of an internal spring.
Figure 4C:
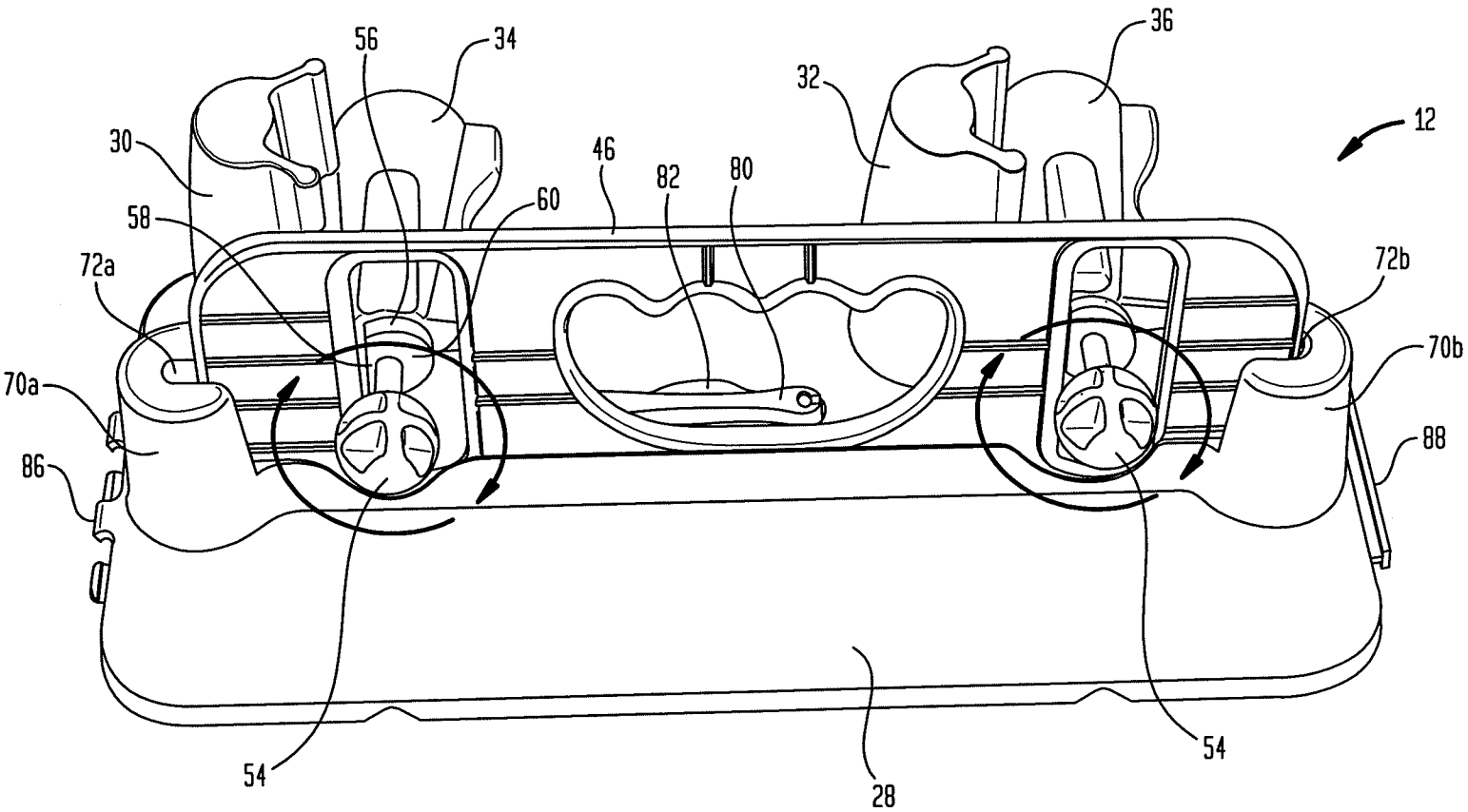
FIG. 4C shows the next step in the cocking process in which the knob is rotated so that the disc can pass through the slot in the trigger plate when the trigger plate is in its first prelaunch position.
Figure 4D:
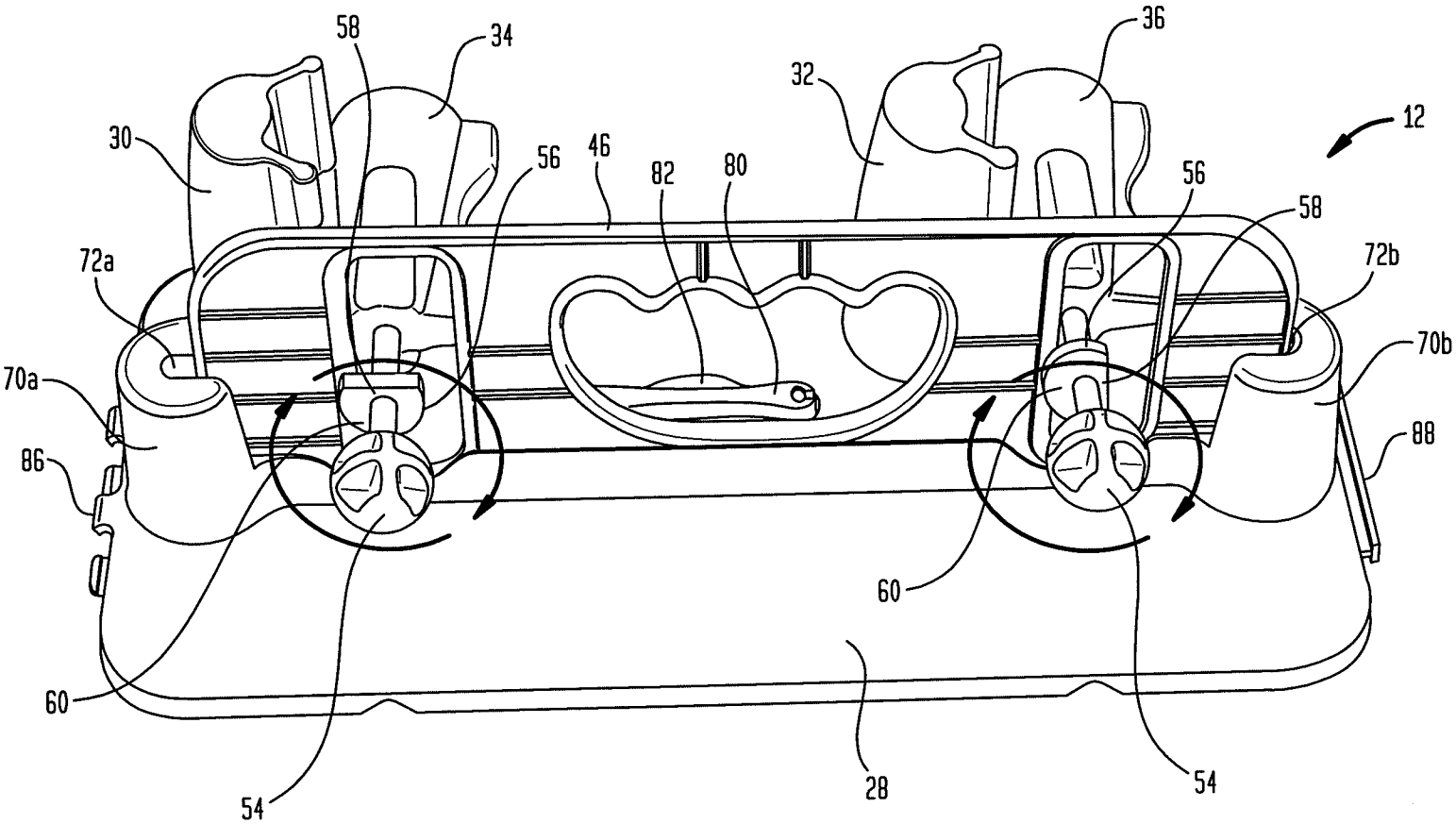
FIG. 4D shows the next step in the launch process where the knob is further rotated after the disc passes through the slot.
Figure 4E:
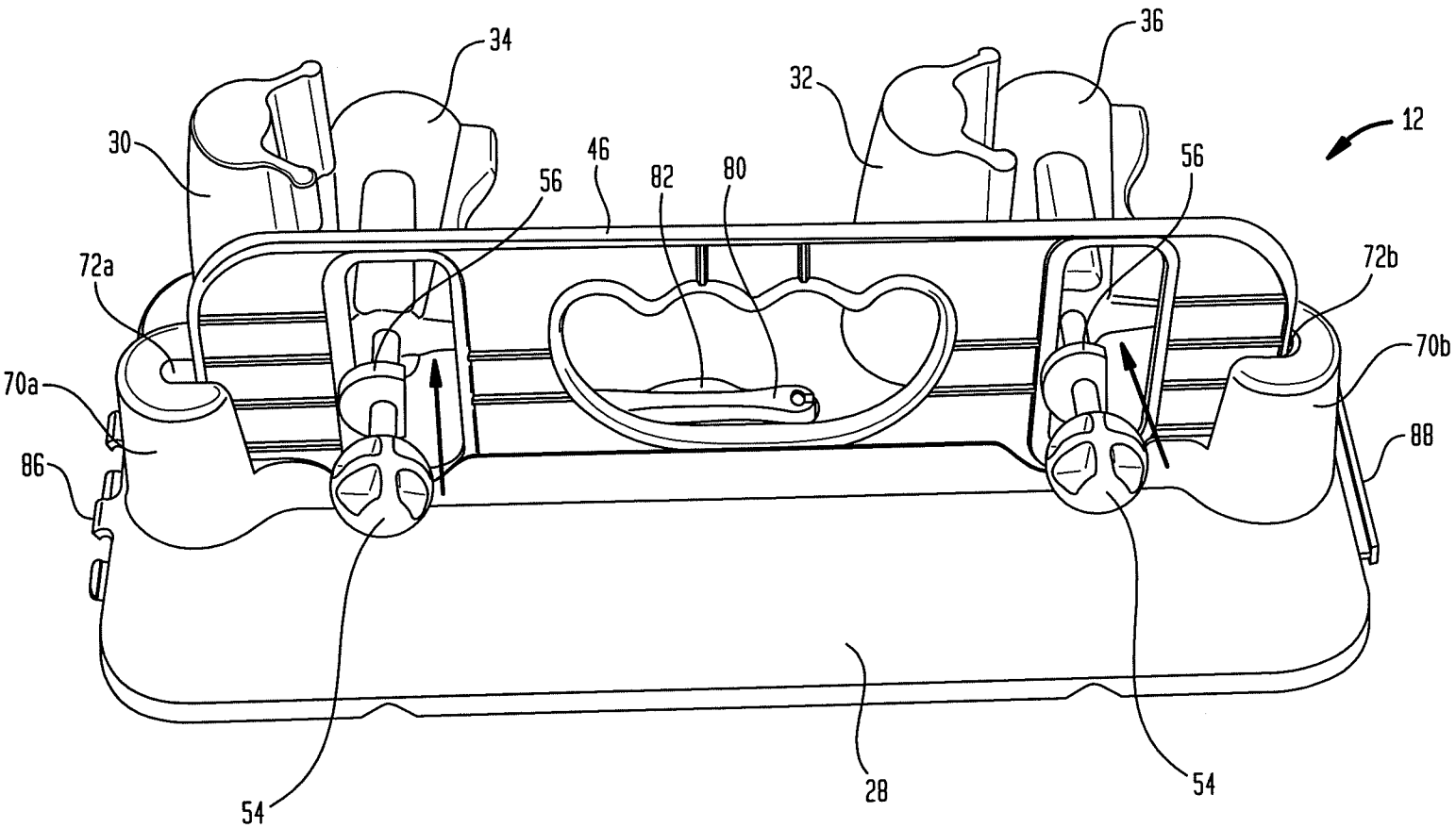
FIG. 4E shows the next step in the launch process where pressure on the knob is relaxed so that the long side of the disc contacts the trigger plate and is held there under spring pressure in the pre-launch mode.
Figure 4F:
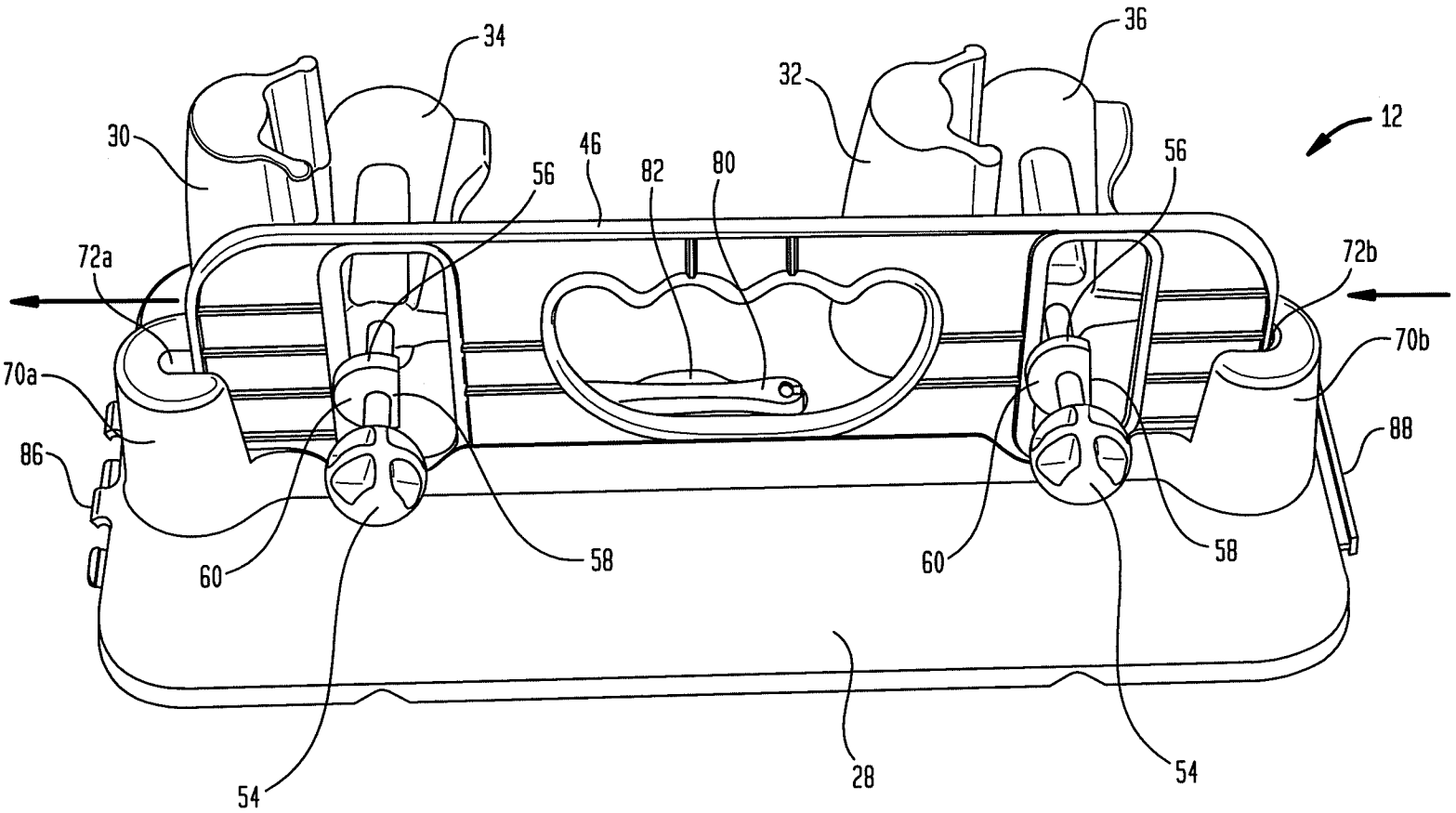
FIG. 4F shows next step in the launch process where the trigger plate is moved sideways so that the discs are no longer held by the trigger plate and so that the discs move through their respective slots under the influence of their internal spring.
Figure 4G:
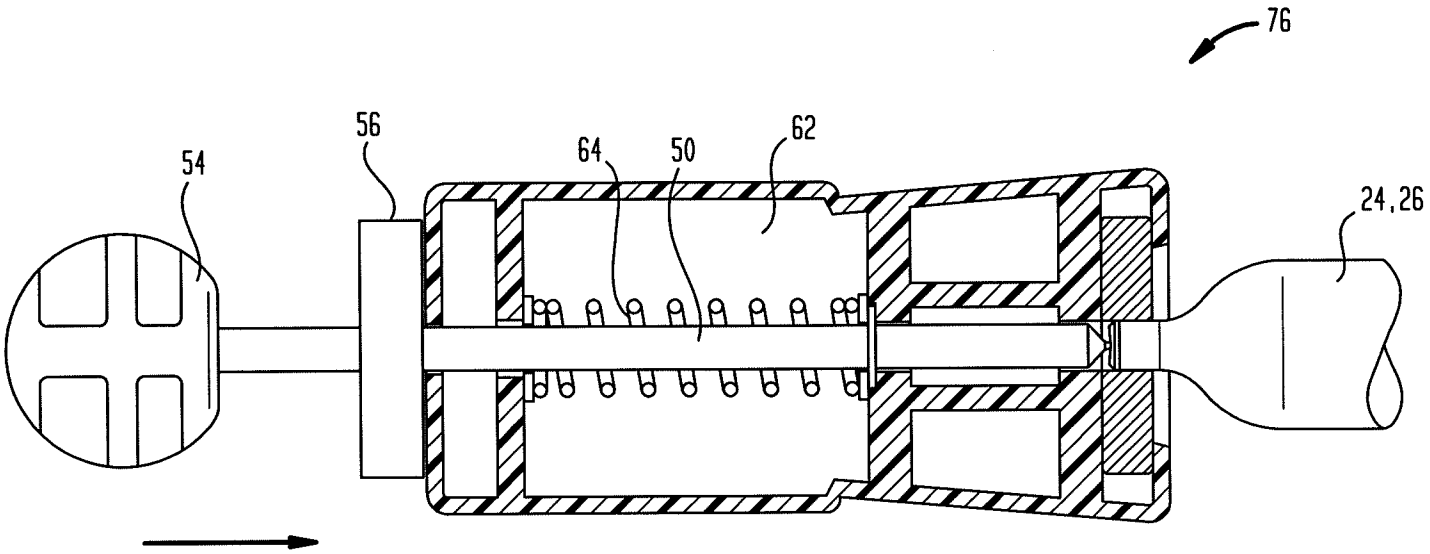
FIG. 4G illustrates the last step in the launch process and comprises a side cross-sectional view of an individual launch module showing the firing pin mechanism puncturing the frangible nozzle of a CO2 cartridge in the released, or fully launched, mode.

FIGS. 4A and 4G show the launcher (12) in the fired, or discharged, or post-launch, position (76).

FIGS. 4B-4F illustrate the steps necessary for cocking and simultaneously triggering the launch of model vehicles (14, 16).

The first step in the cocking process, as shown in FIG. 3, is to begin to pull the knob (54) backwards against the bias of spring (64) as shown in FIG. 4B.

In the next step, as shown in FIG. 4C, the knob (54) is rotated so that the disc (56) can pass through slots (66*a* or 66*b*) of trigger plate (46).

According to the next step, as shown in FIG. 4D, the knob (54) is further rotated so that the long, or big radius, side (60) of the disc (56) is directly opposing a land portion of trigger plate (46).

In the next step, as show in FIG. 4E, pressure on the knob (54) is relaxed so that the long, or big radius, side (60) of the disc (56) contacts land on the trigger plate (46). In this position the firing pin rod (50) is held in the pre-launch mode (74) by the pressure of the disc (56) on the trigger plate (46).

The pre-launch steps as shown in FIGS. 4B-4E are repeated as many times as necessary to set up whatever number of model cars (14,16) are being raced.

The next, and final step, shown in FIG. 4F is to move the trigger plate (46) sidewise so that the discs (56) slip through the respective slots (66*a*,66*b*) of the trigger plate (46). The current invention (10) permits both firing pin mechanisms (48) to be released substantially simultaneously thereby ensuring a fair start to the race and minimizing the effects of the launch on the ultimate performance of the model vehicle (14,16). This is very important because the winner of the race should be determined by the skill of the model car maker rather than by the unpredictability of the launch mechanism (12). According to FIG. 4F the trigger plate (46) is shown moving from its pre-launch position (74) towards its fired or disengaged position (76).

Lastly, as shown in FIG. 4G, the sharp point (52) of the firing pin rod (50) punctures the frangible nozzle end of a CO2 cartridge (24,26) thereby respectively propelling model cars (14,16) down guides wires (18,20) towards stop block (84).

Figure 5A:
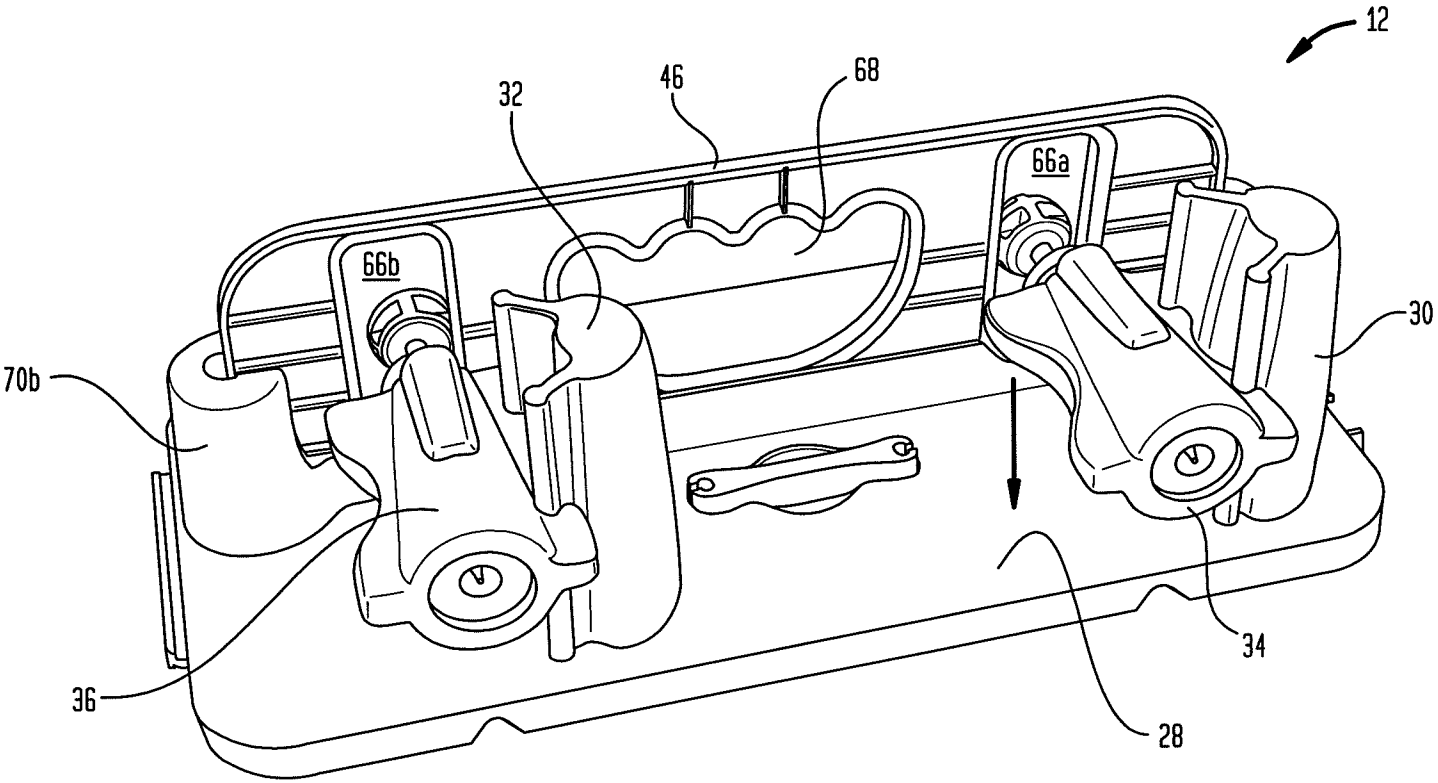
FIG. 5A illustrates a launch module mounted on a tower and shown in a low position.
Figure 5B:
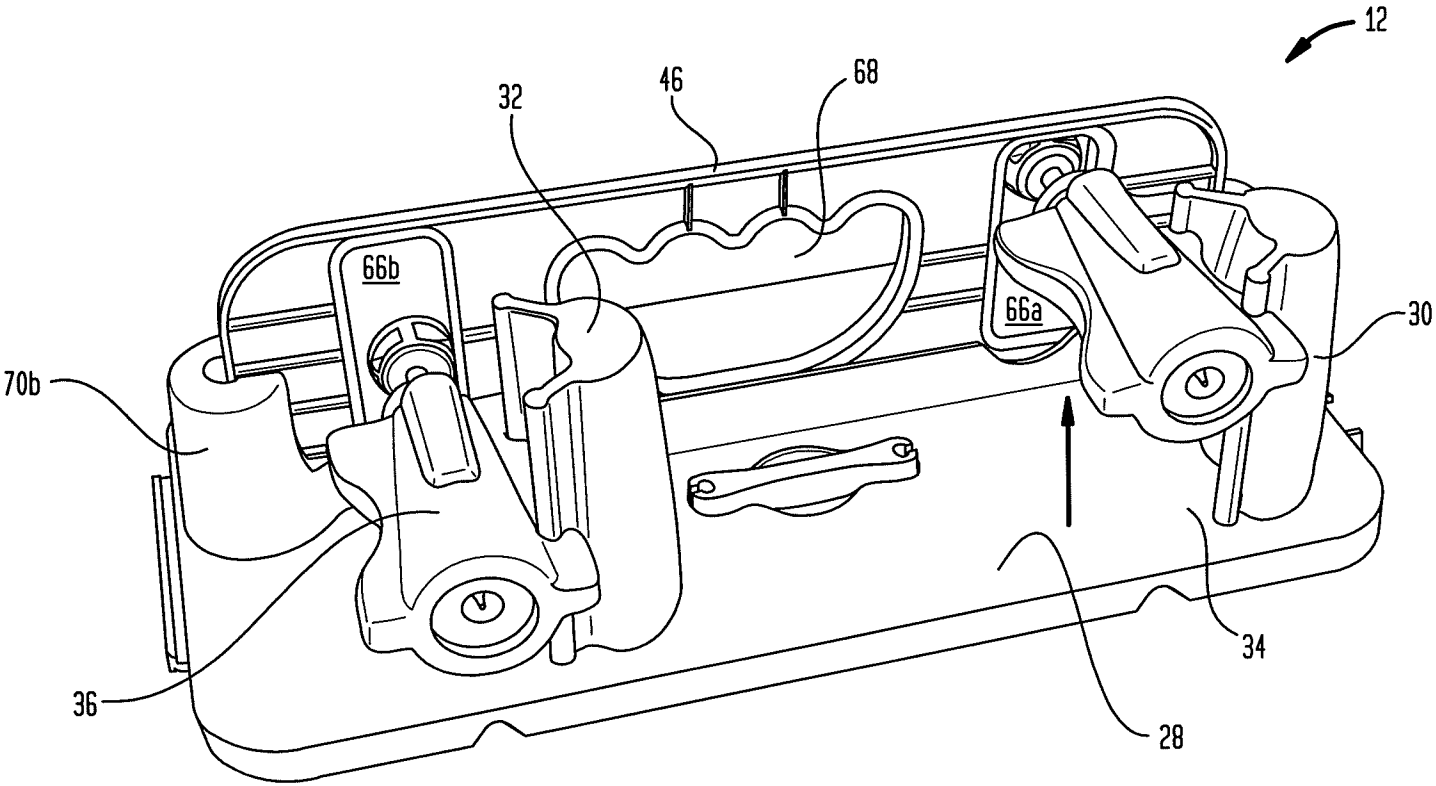
FIG. 5B shows the launch module of FIG. 5A moved to a higher position to launch a taller model vehicle.

As previously discussed, the height of the launch modules (34,36) can be adjusted. Prior to launch and firing, it is desirable to adjust the launch modules (34,36). For example, FIG. 5A illustrates a launch module (34,36) mounted on a tower (30,32) and shown in a low position to accommodate a model car (14,16) which is low to the ground. Conversely, FIG. 5B illustrates a launch module (34,36) of FIG. 5A moved to a higher position in order to launch a taller model vehicle (14,16) which is higher off the ground. This further ensures the fairness of the race by eliminating any bias that the launch mechanism might have towards taller or shorter vehicles.

Figure 6:
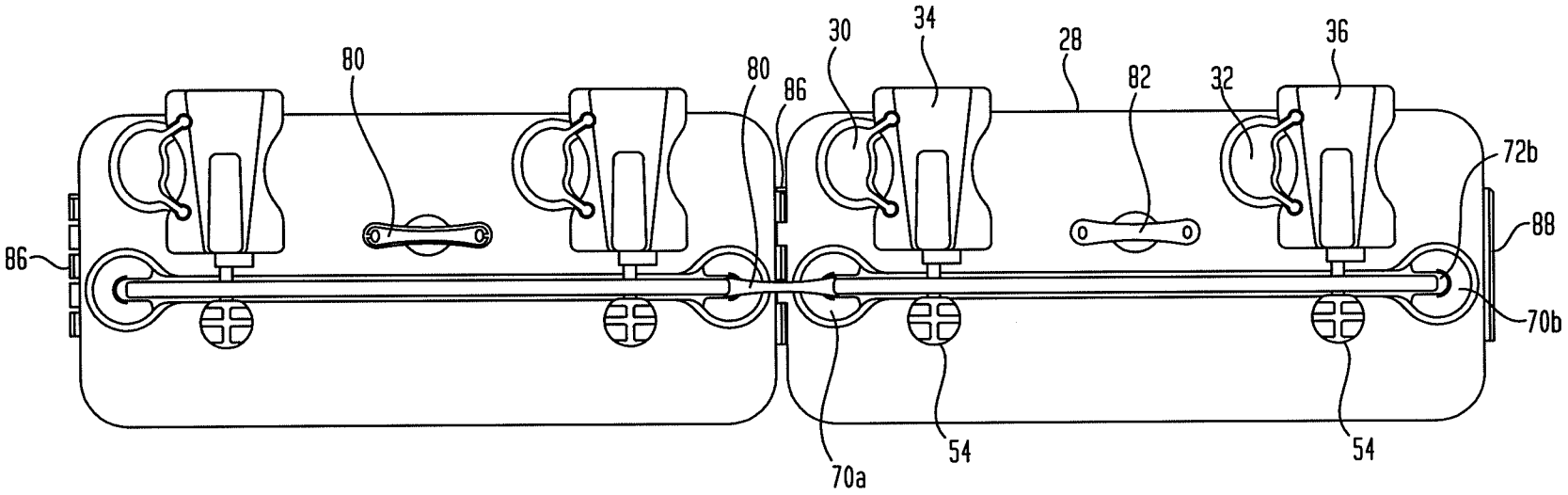
FIG. 6 illustrates two launchers attached at the base plate and also shows the use of a dog bone shaped clip to connect two trigger plates together so that four or more model cars can be launched simultaneously.

Another unique embodiment of the invention (10), shown in FIG. 6, is that it is possible to gang, or couple, several launchers (12) together so that four (4) or more model race cars (14,16) might be launched simultaneously. To accomplish this, each base plate (28) includes engaging elements (86) along its edge so that the base plates (28) do not slip pass each other and are perfectly aligned. A dog bone shaped clip (80), which normally sits in a cavity (82) in the launcher base plate (28), includes grooves that couple a pair of trigger plates (46) to each other. Accordingly, the base plates (28) are perfectly aligned and the trigger plates (46), in addition to being perfectly aligned, are also rigidly connected to each other, so that actuation of one trigger plate (46) will actuate two or more trigger plates (46) simultaneously thereby launching more than two vehicles (14,16) at the same precise moment.

The preferred embodiment of the invention (10,12) has been described with regard to model race cars (14,16) but it is possible to propel other vehicles in a similar manner.

Figure 7A:
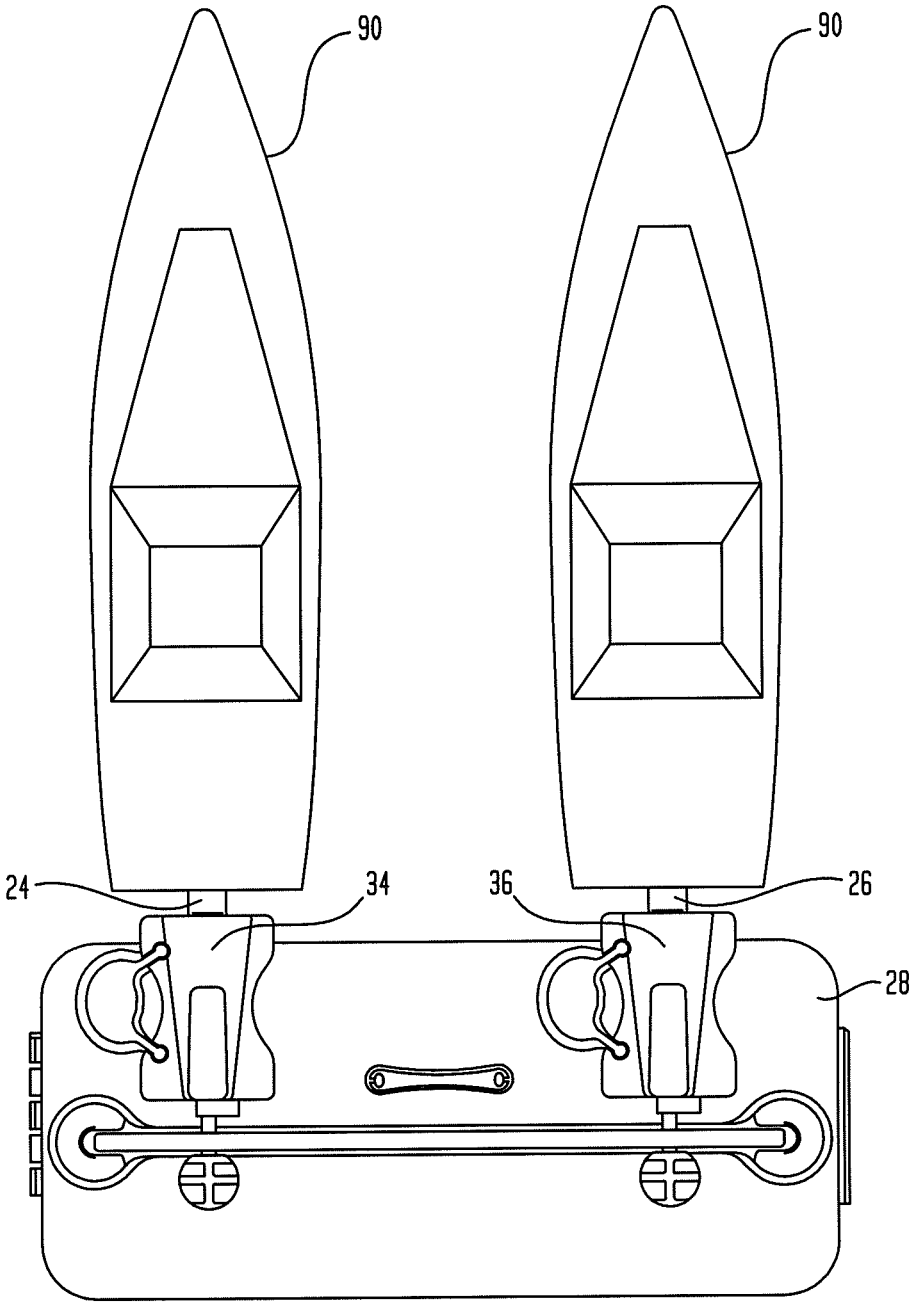
FIG. 7A illustrates an alternative embodiment of the invention where the model vehicles comprise a pair of CO2 propelled model boats.

FIG. 7A illustrates an alternative embodiment of the invention where the vehicles comprise a pair of CO2 propelled model boats (90).

Figure 7B:
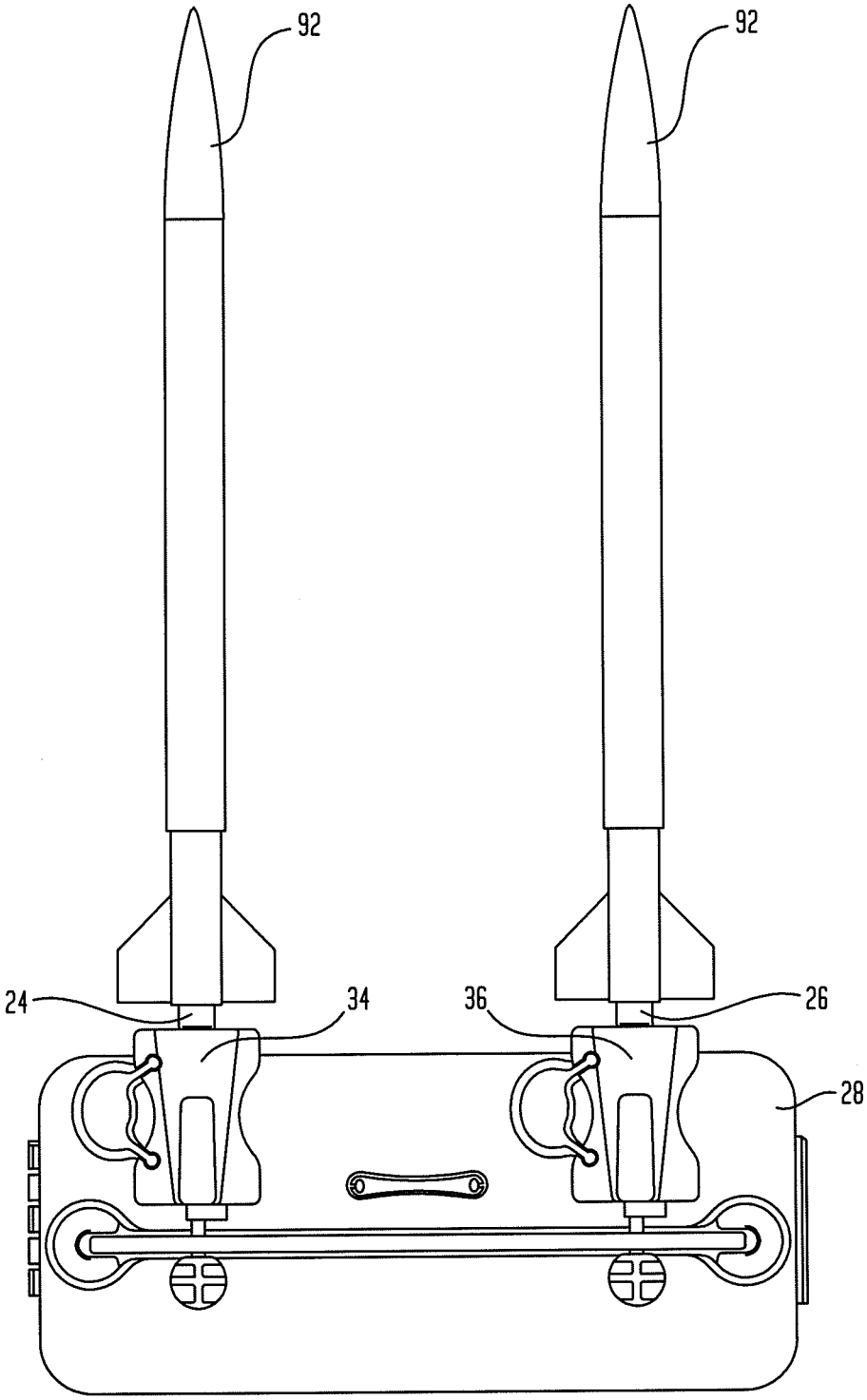
FIG. 7B illustrates another alternative embodiment of the invention where the model vehicles comprise a pair of CO2 propelled model rockets.

FIG. 7B illustrates another alternative embodiment of the invention where the vehicles comprise a pair of CO2 propelled model rockets (92).

The present invention has a number of advantages over prior art efforts to achieve similar results. First, and foremost, the basic launcher (12) is relatively inexpensive and safe to use. The use of a sliding trigger plate (46) and a virtually fool-proof firing mechanism (48) ensures that two or more model cars (14,16) can be launched simultaneously thereby leaving the results of the race primarily to the skill of the model car builder rather than to any other factor. Being able to adjust the firing mechanism (48) vertically further increases the fairness of the competition so as to eliminate any bias towards taller or shorter vehicles.

Lastly, the invention's unique ability to gang, or connect, launchers (12) together in such a way that the base plates are perfectly aligned and the trigger mechanisms are rigidly connected together further ensures that more than two model vehicles (14,16) can be launched fairly and safely simultaneously.

While the invention has been described with reference to the preferred embodiment thereof it will be appreciated by those of ordinary skill in the art that modifications can be made to the parts of the basic invention and the basic concept without department from the scope and spirit of the invention as a whole.

I hereby claim:

1. A launching apparatus for simultaneously launching two or more model racing vehicles, said apparatus comprising:

a base plate;

at least a first and a second tower attached to said base plate, wherein each tower having a first and a second fin, wherein the edge of each fin includes a longitudinal bead running the length thereof;

a first and a second launch module respectively attached to said first and said second tower and respectively including a first and a second firing pin configured to simultaneously puncture a first and a second gas filled canister of a first and a second model vehicle, wherein said first and second launch modules are independently selectively adjustable relative to said first or second towers in a direction perpendicular to the base plate;

a trigger coupled to said base plate and selectively engaged with said first and second firing pins and adapted to simultaneously release said first and second firing pin, wherein said first and second firing pins are adapted to puncture said gas filled propulsion canisters at substantially the same time.

2. The apparatus of claim 1 wherein said first firing pin comprises:

a first rod having a first and a second end and located inside of said first launch module;

a first sharp tip located at the first end of said first rod for puncturing the gas filled propulsion canister of said first vehicle;

a first knob that can be grasped by the user located at said second end of said first rod; a first spring located in said first launch module for biasing said first sharp tip in the direction of said gas filled propulsion canister; and, a first trigger engagement means attached to said first rod for selectively engaging said trigger when said apparatus is cocked and disengaging from said trigger when said trigger is released.

3. The apparatus of claim 2 wherein said second firing pin comprises:

a second rod having a first and a second end and located inside of said second launch module;

a second sharp tip located at the first end of said second rod for puncturing the gas filled propulsion canister of said second vehicle;

a second knob that can be grasped by the user and located at said second end of said second rod;

a second spring located in said second launch module for biasing said second sharp tip in the direction of said gas filled propulsion canister; and, a second trigger engagement means attached to said second rod for selectively engaging said trigger when said apparatus is cocked and disengaging from said trigger when said trigger is released.

4. The apparatus of claim 3 further comprising:

a first and a second trigger support attached to said base, each including a groove therein for slideably receiving said trigger.

5. The apparatus of claim 4 wherein said trigger comprises a trigger plate.

6. The apparatus of claim 5 wherein said trigger plate includes a first and a second slot therein and wherein said first rod of said first firing pin passes through said first slot and said second rod of said second firing pin passes through said second slot.

7. The apparatus of claim 6 wherein said first trigger engagement means comprises a first disc attached to said first rod intermediate said first sharp tip and said first knob, said first disc having a long side and a short side, and wherein said first knob may be pulled away from said first launch module so that said first disc passes through said first slot and can be then rotated by said knob so that said long side of said first disc engages the trigger plate when said trigger plate is in its pre-launch position.

8. The apparatus of claim 7 wherein said second trigger engagement means comprises a second disc attached to said second rod intermediate said second sharp tip and said second knob, said second disc having a long side and a short side, and wherein said second knob may be pulled away from said second launch module so that said second disc passes through said second slot and can be then rotated by said knob so that said long side of said second disc engages said trigger plate when said trigger plate is in its pre-launch position.

9. The apparatus of claim 8 wherein moving said trigger plate sideways within said first and second groves from said pre-launch position towards a launch position causes said first and second firing pin discs to disengage from said trigger plate and said first and second sharp points to substantially simultaneously puncture said gas filled propulsion canisters of said first and second model vehicles.

10. The apparatus of claim 9 further comprising:

a clip for attaching said trigger plate to the trigger plate of a second launching apparatus, wherein the sideways motion of said first trigger plate is transmitted to said second trigger plate so that more than two model vehicles can be launched at substantially the same time.

11. The apparatus of claim 1 further comprising:

a first and a second fin attached to each tower and wherein the edge of each fin includes a longitudinal bead running the length thereof; and, a first and a second groove in said first and second launch module means each having an enlarged portion at the closed end thereof for receiving said longitudinal bead, wherein said first and second launch module may be selectively moved up and down with respect to said tower to match the launch module and firing pin man to the height of the gas canister in a model vehicle.

12. The apparatus of claim 1 wherein said first and second model vehicles comprises model racing cars and said gas fill propulsion canisters comprise carbon dioxide (CO2) cartridges.

13. The apparatus of claim 1 further comprising:

a first and second guide wire attached to said base plate for guiding said first and second model vehicles; and, a stop block means attached to said first and second guide wires at the end removed from said base plate for stopping said vehicles and determining which vehicle won the race.

14. The apparatus of claim 1 wherein said model vehicles comprise model boats.

15. The apparatus of claim 1 wherein said vehicles comprise model rockets.

16. The apparatus of claim 1 wherein said base plate further includes at least one additional tower and launcher module and said trigger is adapted to release each firing pin included in each additional launcher module at substantially the same time as the first and second firing pins.

17. An launching apparatus for simultaneously launching two or more model racing vehicles, said apparatus comprising:

a base plate;

a first and a second tower attached to said base plate;

a first launch module adjustably attached to said first tower and including a first firing pin configured to simultaneously puncture a first gas filled canister of a first model vehicle;

a second launch module adjustably attached to said second tower and including a second firing configured to simultaneously puncture a second gas filled canister of a second model vehicle;

a first and second height adjustment means associated with said first and second towers respectively for selectively adjusting the height of said first and second launch module with respect to the base plate of said apparatus, wherein said first and second launch module may be selectively moved up and down with respect to said tower to align the launch module and firing pin to the height of the gas canister in a model vehicle;

a trigger coupled to said base plate and selectively engaged with said first and second firing pins and adapted to simultaneously release said first and second firing pin when the trigger removed from said base plate, wherein said first and second firing pins, when released, are configured to puncture said gas filled propulsion canisters at substantially the same time.

18. The apparatus of claim 17 wherein said base plate further includes a first and a second engagement element on each side end of said base plate, said first and said second engagement elements are complimentarily configured to couple said base plate with one or more additional base plates of one or more additional launching apparatuses to accommodate additional model vehicles.

19. The apparatus of claim 18 wherein said trigger is configured to simultaneously release all firing pins of all said launching apparatuses so that said gas filled canisters are punctured at substantially the same time.

* * * * *